US005699029A

United States Patent [19]

Young et al.

[11] Patent Number: 5,699,029

[45] Date of Patent: Dec. 16, 1997

[54] SIMULTANEOUS COUPLING BANDPASS FILTER AND METHOD

[75] Inventors: Frederick A. Young, Huntington Beach; Keith N. Loi, Rosemead; Richard L. Bennett, Torrance, all of Calif.

[73] Assignee: Hughes Electronics, Los Angeles, Calif.

[21] Appl. No.: 637,967

[22] Filed: Apr. 30, 1996

[51] Int. Cl.[6] ..... H01P 1/208; H01P 1/213

[52] U.S. Cl. ..... 333/212; 333/129

[58] Field of Search ..... 333/126, 129, 333/132, 134, 202, 212, 230

[56] References Cited

U.S. PATENT DOCUMENTS

| | | | |
|---|---|---|---|
| 3,969,692 | 7/1976 | Williams et al. | 333/212 |
| 4,180,787 | 12/1979 | Pfitzenmaier | 333/212 |
| 4,246,555 | 1/1981 | Williams | 333/212 X |
| 4,360,793 | 11/1982 | Rhodes et al. | 333/212 |
| 4,410,865 | 10/1983 | Young et al. | 333/208 |
| 4,721,933 | 1/1988 | Schwartz et al. | 333/212 |

OTHER PUBLICATIONS

D. Fink and D. Christiansen, *Electronic engineer's Handbook*, McGraw-Hill Book Company, 1989, pp. 12-5 through 12-8, and 12-29 through 12-30.

I. Bahl and P. Bhartia, *Microwave Solid State Circuit Design*, John Wiley & Sons, 1988, pp. 271-276.

*Primary Examiner*—Robert Pascal

*Assistant Examiner*—Barbara Summons

*Attorney, Agent, or Firm*—Terje Gudmestad; Wanda K. Denson-Low

[57] ABSTRACT

A high performance bandpass filter is produced by adding one or more "simultaneous couplings" to a conventional resonant cavity filter. A "simultaneous coupling" is created when a filter's input or output signal, normally coupled to a filter's first or last cavity respectively, is coupled to one or more other cavities. Each simultaneous coupling causes a finite-frequency insertion loss pole to be created, which produces a quasi-elliptic frequency response on its side of the passband. These poles may be placed on the left and/or right sides of the passband, so that both symmetric and asymmetric quasi-elliptic frequency responses are realizable. A diplexer constructed from two such bandpass filters has the extremely sharp selectivity provided by two asymmetric bandpass filters, thus providing a high degree of receive/transmit isolation.

20 Claims, 5 Drawing Sheets

SIMULTANEOUS COUPLING BANDPASS FILTER AND METHOD

BACKGROUND OF THE INVENTION

1. Field of the Invention

This invention relates to electromagnetic resonant cavity bandpass filters, and more specifically to coupling structures and methods used to make high performance bandpass filters having a quasi-elliptic frequency response.

2. Description of the Related Art

Resonant cavity bandpass filters are used in satellite communication systems operating at microwave frequencies. To conserve weight and power aboard a satellite, a single antenna is often used to simultaneously transmit and receive a plurality of individual signals to and from the ground. Each signal occupies a narrow band of frequencies around a unique carrier frequency.

A bandpass filter ideally allows a narrow range of frequencies to pass through it unattenuated, and blocks out all other frequencies. This narrow range of frequencies is the filter's "passband." A satellite communication system uses a number of bandpass filters, with each filter having a unique passband corresponding to the narrow band of frequencies used by one individual signal. By feeding the plurality of signals received by the antenna through a series of bandpass filters, the individual signals can be extracted. Similarly, signals to be transmitted are fed to a series of bandpass filters to insure that each signal stays within a narrow band of frequencies allotted to that signal.

A typical satellite communications system is shown in FIG. 1. A number of antenna elements 10 share one common dish 12. Connected to each element is a "diplexer" 24, consisting of a "receive" filter 26, used to extract a single signal of a particular carrier frequency from the signals received by the antenna, and a "transmit" filter 28 that insures that a signal to be transmitted by the antenna is within its allotted narrow frequency band. The outputs of the receive filters 26 are processed by receiver electronics 30. Transmit filters 28 are fed by transmitter electronics 32.

Such a system is typically allotted a limited bandwidth, which is then split into individual data channels, each of which has a unique bandwidth. For example, a system may be allotted a total bandwidth of 500 MHz, which is then split into a number of individual data channels each having a bandwidth of about 36 MHz, with about a 5 MHz "guard band" between channels. A guard band is a portion of bandwidth that is left unused to help keep the individual signals isolated.

Resonant cavity bandpass filters are constructed by "coupling" a number of cavities together with a certain topology. In a basic bandpass filter as shown in FIG. 2, an input signal enters a first cavity 42 through a "main" coupling 44, propagates sequentially through second 46, third 48 and fourth 50 cavities via main couplings 52, 54 and 56, and emerges as a filtered signal 58 from the fourth cavity 50 through a main coupling 60. The sizes and shapes of the cavities, the materials used to construct the filter, and the type and location of the couplings all affect the frequency response. An aperture, a screw going between cavities, or a metal element known as a "probe" that protrudes into a cavity are all examples of couplings. Each coupling has a particular magnitude and phase characteristic associated with it. The structure shown in FIG. 2 is known as a "folded-ladder," with the third 48 and the fourth 50 cavities adjacent to the second 46 and first 42 cavities, respectively.

As shown in FIG. 3, the frequency response plot of a bandpass filter has a passband portion 70 on either side of a carrier frequency $f_c$ (71), and "skirt" portions 72, 74, i.e. the transition regions on either side of the passband. Bandpass filters used in a diplexer preferably have skirts that are "sharp," in which the frequency response curve drops or "cuts-off" rapidly on either side of the passband. Sharper skirts permit adjacent data channels to be placed closer together, and thus a greater number of data channels can be fit within an allotted frequency spectrum. The frequency response in FIG. 3 is for a basic bandpass filter having four cavities as shown in FIG. 2. Such a filter produces a frequency response as described by the Chebyshev approximation, in which the number of cavities determines the order of the Chebyshev polynomial, and thus the number of humps in the passband 70. Monotonic skirts 72, 74, providing a gently sloping cut-off, are also characteristic of this type of filter. Filters producing a Chebyshev response are discussed in D. Fink and D. Christiansen, *Electronic Engineer's Handbook*, McGraw-Hill Inc. (1989), pp. 12-5 through 12-8.

One method of sharpening a bandpass filter's skirts is by adding additional cavities; in general, the more cavities a signal must propagate through, the sharper the skirts will be. However, adding cavities will add weight and size to the filter, and may also introduce signal losses. These effects are unwanted aboard a satellite.

Another method to increase the sharpness of a bandpass filter's skirts is to add an additional coupling to the filter that, for example, couples the first cavity to the fourth cavity. This is known as a "bridge" coupling. Adding bridge couplings to a resonant cavity filter will cause one or more finite-frequency insertion loss poles to appear in the filter's frequency response, and will convert the response from a Chebyshev approximation to one resembling an elliptic approximation, referred to herein as "quasi-elliptic." This type of response is characterized by a sharper cut-off on the side of the passband on which a pole lies, and ripples in the region just beyond the sharpened skirt. Filters having responses that correspond to an elliptic approximation are discussed in D. Fink and D. Christiansen, *Electronic Engineer's Handbook*, McGraw-Hill Inc. (1989), pp. 12–29 through 12–30. Thus, the use of bridge couplings can produce a frequency response with sharper skirts without adding cavities. However, a bridge coupling is in the direct path of a propagating signal. This makes the phase characteristic of the coupling critical to the filter's frequency response, and the location of the poles is strongly dependent on the filter's main couplings. These factors make finite-frequency insertion loss poles created with bridge couplings extremely difficult to control.

A bandpass filter's frequency response can be "symmetric," in which the skirts on the left and right side of the passband have an equal rate of change, or "asymmetric," in which one skirt is sharper than the other. Both symmetric and asymmetric frequency responses can be realized with resonant cavity bandpass filters. In some situations, however, such as in a diplexer application as discussed above, it is not necessary to have a symmetric response. FIG. 4 shows a frequency response 80 for a receive filter of a diplexer, as well as a response 82 for a transmit filter. For a diplexer, in which two filters share a common antenna element, it is only necessary that the skirts be sharp in the "overlap" area 84 between the bandwidth 86 allotted for the received signal and the bandwidth 88 allotted for the transmitted signal, to keep a signal transmitted by the shared element isolated from a signal received by the element. An asymmetric frequency response is shown for each of the two filters, but two filters having a symmetric frequency response could provide the needed isolation as well. However, for a symmetric response filter to provide the same degree of skirt sharpness in the overlap area as can be provided by an asymmetric response filter, additional cavities or bridge couplings must be used. However, bridge couplings and additional cavities introduce problems as discussed above, and should be avoided if possible.

A type of bridge coupling referred to as a "diagonal coupling" has been used to produce bandpass filters with either symmetric or asymmetric quasi-elliptic frequency responses, and is described in Young, et al., U.S. Pat. No. 4,410,865 "Spherical Cavity Microwave Filter." This technique suffers from the same problems as the bridge couplings described above, producing finite-frequency insertion loss poles that are difficult to control, because they are strongly dependent on the behavior of the main couplings.

Satellite communication systems require "high performance" bandpass filters. A high performance bandpass filter is one in which a signal within the filter's passband is distorted and attenuated only slightly, if at all, as it passes through the filter, and signals outside of the passband are sharply attenuated. This performance is critical for use on a satellite, for example, where low-loss bandpass filters help minimize power consumption, and sharply defined passbands allow the satellite to handle more channels of data. It is also desirable that such filters be as lightweight and compact as possible.

SUMMARY OF THE INVENTION

A novel filter topology is presented that provides a simple, mechanical means of constructing high performance bandpass filters that have quasi-elliptic frequency responses. The invention is useful for filters operating in the microwave portion of the frequency spectrum, in which resonant cavities are coupled together to form a bandpass filter. Such filters are used in satellite communication systems, for example.

A high performance bandpass filter is produced by adding one or more "simultaneous couplings" to a conventional multiple cavity bandpass filter. A "simultaneous coupling" as defined herein is created when a filter's input signal, normally coupled to the filter's first cavity, is coupled to one or more other cavities as well, so that the input signal is simultaneously coupled to both the first cavity and the other cavities. A simultaneous coupling is also created when a filter's output signal, normally coupled to the filter's last cavity, is coupled to one or more other cavities. Each simultaneous coupling added to a filter structure will cause a finite-frequency insertion loss pole to be created. This pole has a frequency that is adjustable and can be located on either side of the passband, and converts a frequency response having monotonic skirts to one that is quasi-elliptic on its side of the passband.

A preferred bandpass filter features four cavities in a folded-ladder structure, with one simultaneous coupling which couples the input signal to both the first and second cavities, and one simultaneous coupling which couples the output signal to both the third and fourth cavities. These two simultaneous couplings produce respective finite-frequency insertion loss poles. The phase characteristic of a simultaneous coupling implemented per the present invention is simply positive or negative. By manipulating the sign of the simultaneous coupling's phase characteristic, it may be placed on the left or the right side of the passband, as desired. By placing both finite-frequency insertion loss poles on one side of the passband, an asymmetric quasi-elliptic frequency response is attained. A symmetric frequency response may be achieved by placing one pole on each side of the passband.

A high performance diplexer is built from two bandpass filters which feature simultaneous couplings. Preferably, one filter has an asymmetric response that is sharply cut-off on the right side of its passband, and the second filter has an asymmetric response that is sharply cut-off on the left side of its passband, with the two passbands separated by a small guard band. The extremely sharp selectivity provided by the two asymmetric bandpass filters provides a high degree of receive/transmit isolation.

More finite-frequency insertion loss poles can be added, resulting in ever sharper skirts, by using additional simultaneous couplings. For example, an input signal may be simultaneously coupled to four cavities of an eight cavity filter structure, producing four finite-frequency insertion loss poles.

Further features and advantages of the invention will be apparent to those skilled in the art from the following detailed description, taken together with the accompanying drawings.

DETAILED DESCRIPTION OF THE INVENTION

A novel bandpass filter topology is presented for creating lightweight, compact, high performance bandpass filters. The invention attains these goals with the use of "simultaneous couplings," which enable the realization of finite-frequency insertion loss poles that are nearly independent of the filter's main couplings. By properly adjusting these couplings, both asymmetric and symmetric high performance bandpass filters can be built.

Figure 1:
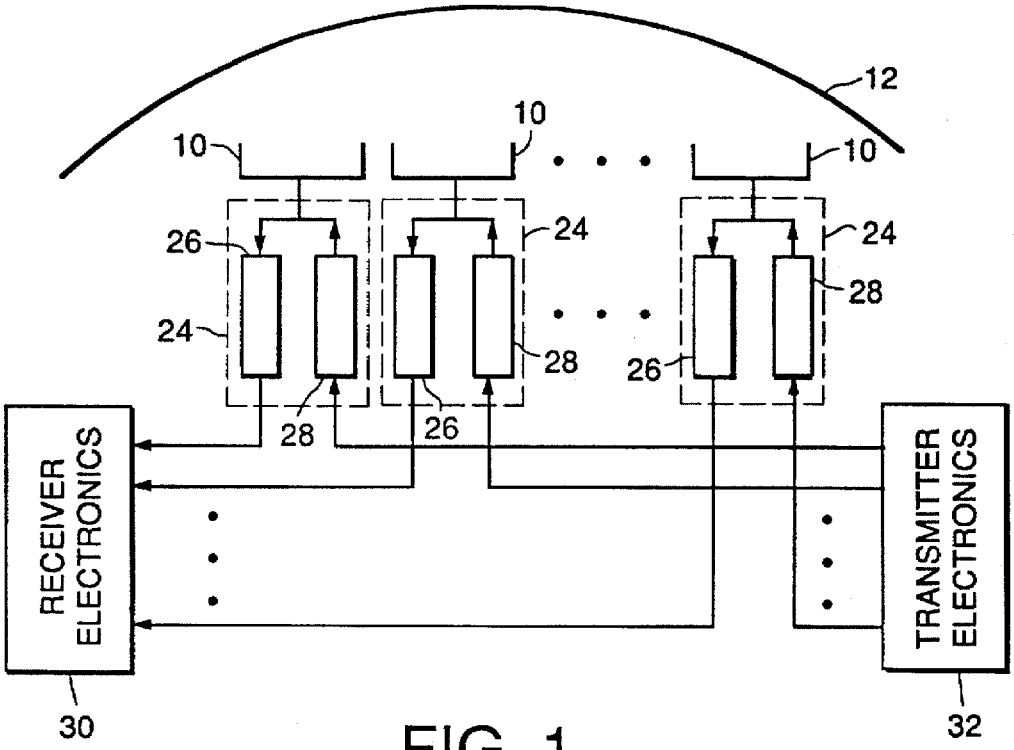
FIG. 1 ( PRIOR ART )
FIG. 1, described above, is a block diagram of a conventional satellite communications system.
Figure 2:
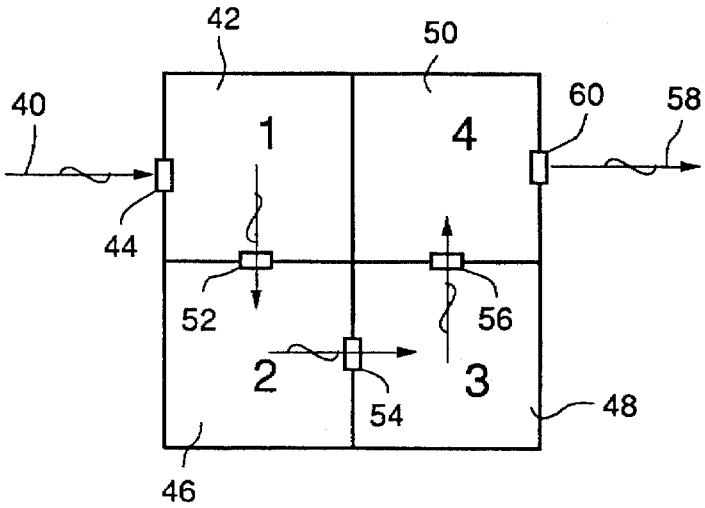
FIG. 2 ( PRIOR ART )
FIG. 2, described above, is a simplified schematic of a conventional basic bandpass filter.
Figure 3:
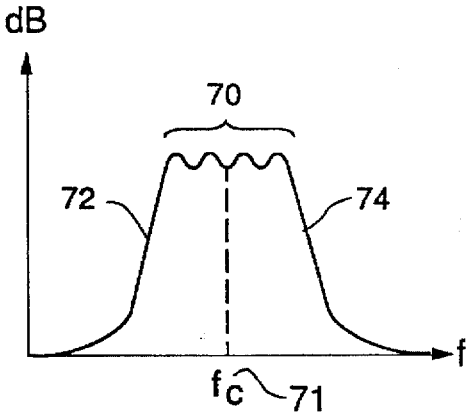
FIG. 3 ( PRIOR ART )
FIG. 3, described above, is a plot of a conventional bandpass filter's frequency response.
Figure 4:
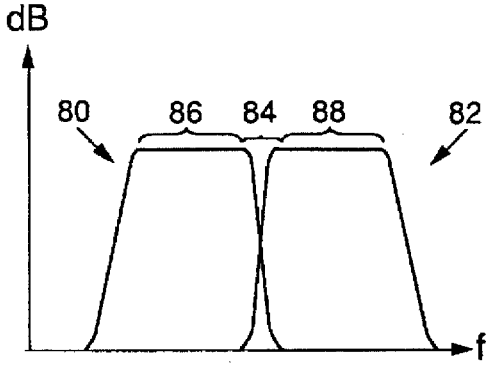
FIG. 4 ( PRIOR ART )
FIG. 4, described above, is a plot of a conventional diplexer's frequency response.
Figure 5:
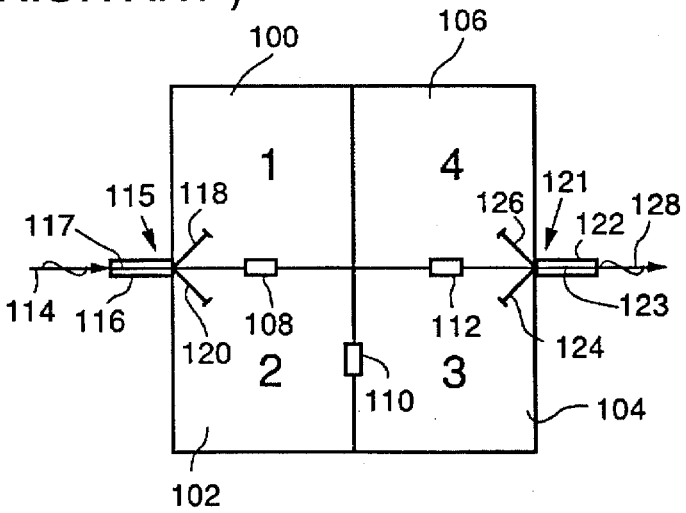
FIG. 5 is a simplified schematic of a bandpass filter with simultaneous couplings in accordance with the present invention.

A preferred bandpass filter featuring simultaneous couplings is shown in FIG. 5. The filter has first 100, second 102, third 104 and fourth 106 resonant cavities coupled together in a folded-ladder structure, with the third and fourth cavities adjacent to the second and first cavities, respectively. The filter has main couplings, preferably in the form of apertures, with a first main coupling 108 between the first and second cavities, a second main coupling 110 between the second and third cavities, and a third main coupling 112 between the third and fourth cavities. An input signal 114 is applied to an input coupling 115 at the juncture of cavities 100 and 102. Coupling 115 is comprised of a transmission line 116 with a center conductor 117, and two metallic probes 118, 120. The two probes 118, 120 are joined together at one end, and this junction is connected to the center conductor 117. The other end of probe 118 protrudes into the first cavity 100, and the other end of probe 120 protrudes into the second cavity 102. The input signal 114 travels down the center conductor 117 of the transmission line 116 and into both probes 118, 120, and is thus coupled into both the first and second cavities simultaneously; coupling 115 is therefore referred to as a simultaneous coupling. A "simultaneous coupling" as used herein exists if a filter's input signal is coupled to any cavity in addition to the first, or if the filter's output signal is coupled to any cavity in addition to the last.

The output side of the filter is similarly constructed. Simultaneous coupling 121 comprises a transmission line 122 with a center conductor 123 connected to two probes 124, 126 joined to the center conductor at one end. Probe 124 protrudes into the third cavity 104, and probe 126 protrudes into the fourth cavity 106. The filter's output signal 128 is thus coupled to both third and fourth cavities simultaneously.

Figure 6:
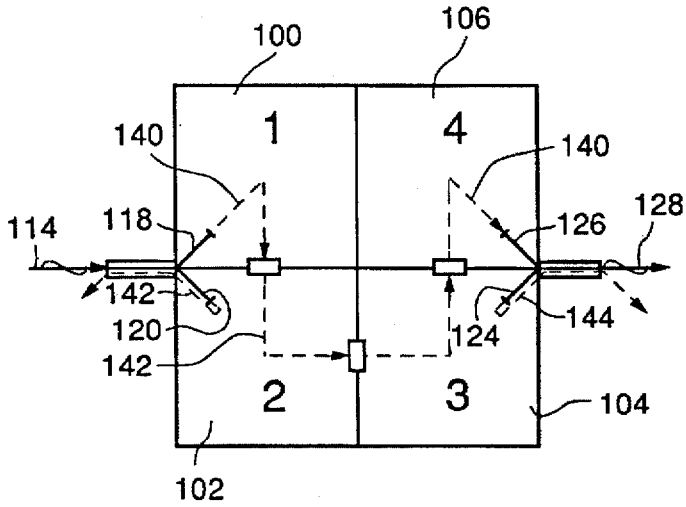
FIG. 6 is a simplified schematic indicating the paths a signal may follow through the bandpass filter shown in FIG. 5.

Due to the presence of probe 120, two signal paths are created for the input signal 114. As shown in FIG. 6, the first signal path 140 takes the signal sequentially through the cavities, entering the first cavity 100 via probe 118 and exiting the last cavity 106 via probe 126. This path provides a basic Chebyshev bandpass filter frequency response, with monotonic skirts. The second signal path couples the input signal 114 to the second cavity 102 via probe 120. When the input signal is coupled to the second cavity in this way, a finite-frequency insertion loss pole is created. The frequency at which the pole is created is adjustable (as described below), and can be placed on either side of the passband. By placing a pole at the edge of the filter's passband, a much sharper skirt is produced than is provided by the first path 140 alone. The pole is created because the second cavity rejects the input signal at the pole frequency, due to the second cavity's simultaneous resonance behavior. This effect provides what is essentially a notch filter function at the pole frequency. The input signal is rejected almost immediately upon entering the second cavity, and is therefore not in the direct path of signal propagation, as is the case with bridge and diagonal bridge couplings. As a result, the placement of the pole is nearly independent of the filter's main couplings, as opposed to the strong dependence exhibited by bridge couplings. When the notch-like function caused by the simultaneous coupling is combined with the Chebyshev frequency response of the first path, a quasi-elliptic frequency response results, with a very sharp skirt on the side of the passband in which the finite-frequency insertion loss pole lies.

Similarly, the addition of probe 124 provides a second path 144 for the filter's output signal 128. The first path 140 takes the propagating signal through the third cavity 104 and fourth cavity 106, where it is coupled to the outside of the filter via probe 126 and becomes the filter's output signal 128. Probe 124 couples the output signal into the third cavity 104, creating a finite-frequency insertion loss pole at a particular frequency. This pole has the same advantageous features as that created by probe 120: it is nearly independent of the main couplings, and may be adjusted so that it is located on the edge of the filter's passband.

Only one such finite-frequency insertion loss pole need be created to improve the sharpness of the frequency response on one side of the passband. Thus, a filter featuring just one simultaneous coupling will significantly improve filter performance. Additional finite-frequency insertion loss poles are desirable, however, as each pole further improves the sharpness of the response. The embodiment of the filter shown in FIG. 5 provides two simultaneous couplings, and thus two poles. By using more than two simultaneous couplings, ever greater improvements in performance are possible. Realizing such a filter may be more difficult than the relatively straightforward four-cavity/two simultaneous coupling filter described above, however.

Figure 7:
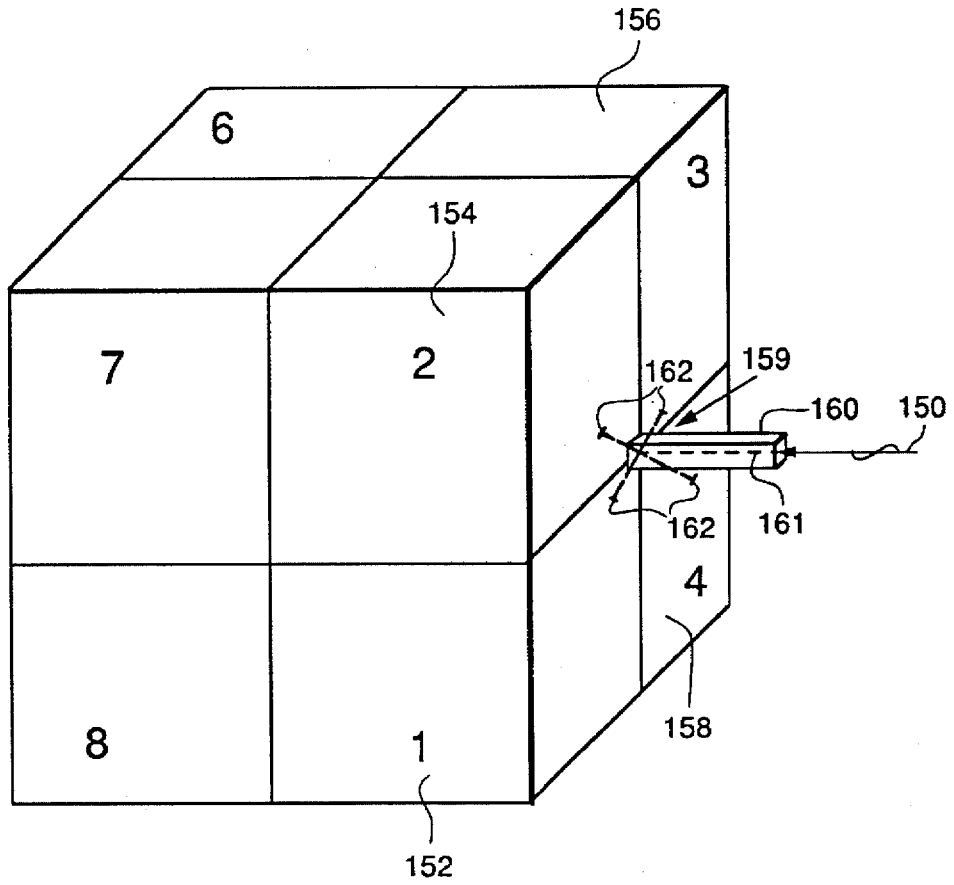
FIG. 7 is a perspective view of an eight-cavity bandpass filter using simultaneous couplings in accordance with the present invention.

FIG. 7 shows an eight-cavity filter structure in which a second four-cavity folded-ladder layer has been placed atop a first four-cavity layer, forming a cube-shaped structure. Main couplings link the eight cavities in sequence. The input signal 150 is coupled to first 152, second 154, third 156 and fourth 158 cavities via a simultaneous input coupling 159 which comprises a transmission line 160 with a center conductor 161, with the center conductor connected to four probes 162. This simultaneous coupling 160 produces three finite-frequency insertion loss poles that are nearly independent of the filter's main couplings.

It is preferred that a simultaneous coupling as discussed herein be implemented with couplings that are internal to the cavities. An internal coupling has essentially no line length associated with it, and thus a signal simultaneously coupled into a cavity is simply either in-phase or out-of-phase with the signal propagated through that cavity. A simultaneous coupling may be achieved with an external connection, but extremely close attention must then be paid to the length of the external line to avoid the creation of spurious passbands.

As long as the probes are internal to the cavities, this simple phase relationship will be maintained. The probes' length, shape, angle and conductivity of material will, however, affect the magnitude characteristic of the coupling, and must be taken into account when designing and building the filter.

Figure 8:
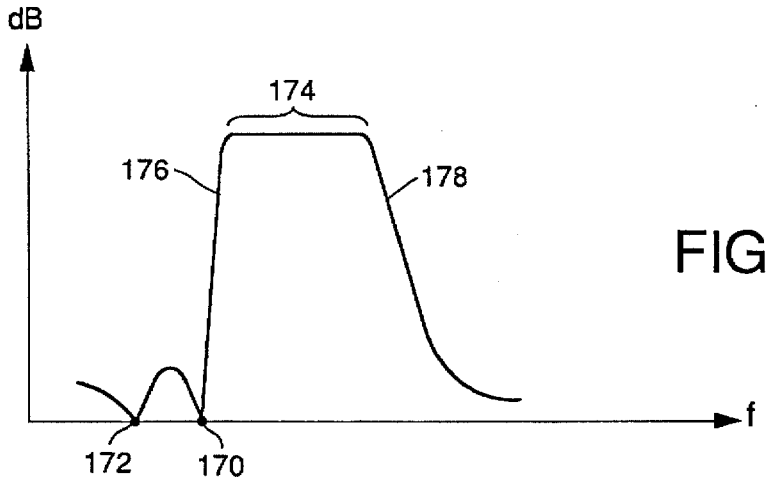
FIGS. 8, 9, and 10 are frequency response plots that may be achieved with the bandpass filter shown in FIG. 5.
Figure 9:
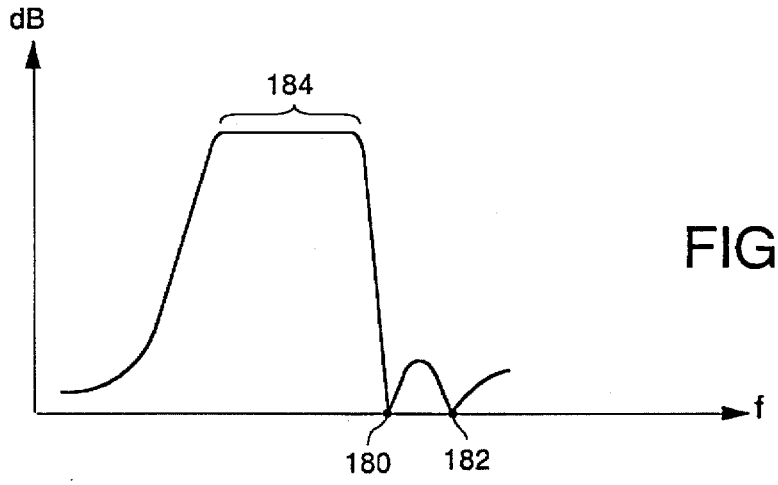
Figure 10:
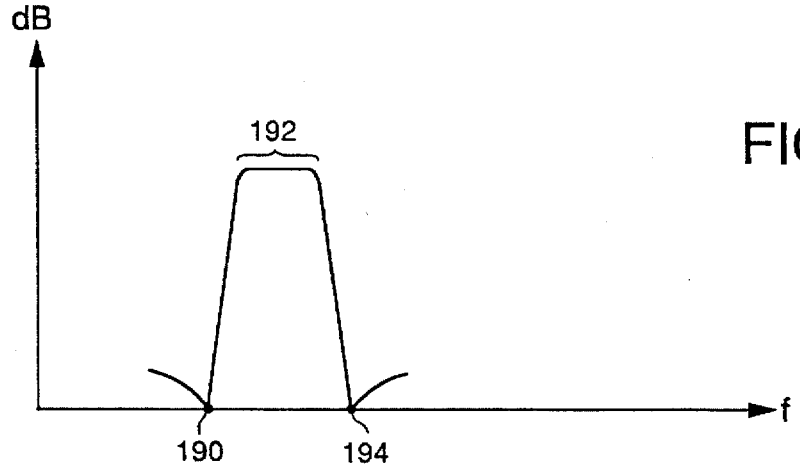

An asymmetric frequency response is created when more finite-frequency insertion loss poles are on one side of the passband than the other. For the first filter embodiment described above, placing the two poles created by probes 120 and 124 (referring to FIG. 5) on the same side of the passband creates an asymmetric response. This type of response is shown in FIG. 8. The two finite-frequency insertion loss poles 170, 172 are on the left side of the passband 174, making the left side skirt 176 much sharper than the right side skirt 178. FIG. 9 shows a similar response, but with the two poles 180, 182 adjusted to fall on the right side of the passband 184. FIG. 10 shows a symmetric frequency response, in which one finite-frequency loss pole 190 is adjusted to fall on the left side of the passband 192, and one 194 is adjusted to fall on the right side. Placing one pole on each side of the passband will sharpen the passband's skirts and produce a quasi-elliptic response, but will not produce skirts as sharp as would be provided with two poles on one side. Each of the frequency responses shown in FIGS. 8, 9, and 10 are attainable with the first embodiment of the bandpass filter described above.

Filters built per the present invention have demonstrated excellent performance. A four-cavity bandpass filter with two simultaneous couplings had a passband that was about 40 MHz wide around a carrier frequency of 1.64 GHz, with the two finite-frequency insertion loss poles created by the simultaneous couplings placed on the left side of the passband in the vicinity of the passband edge, both poles being greater than 90 db below the passband. Similar results have been obtained for filters in which both poles are placed on the right side of the passband. A filter adjusted to provide symmetric response had a bandwidth of about 40 MHz around a 1.64 GHz carrier frequency, with one pole on each side of the passband in the vicinity of the passband edge.

To construct a filter using finite-frequency insertion loss poles created with simultaneous couplings as provided by the present invention, the desired bandpass characteristics of the filter are first defined. A network topology matrix is then prepared which describes the association of all loop currents and node voltages of a network by means of a complex matrix equation. The solution of this complex matrix equation allows the filter designer to determine whether or not the filter transfer function satisfies the desired bandpass characteristics. The entries of this matrix, representing a set of simultaneous linear equations and linking the circuit loop currents with the node voltages, contain the coupling coefficients of all the defined coupling paths. The solution of this complex matrix equation provides all the filter design elements, including the amplitude and phase of each coupling coefficient. This filter design procedure is well-known in the field, and is described in I. Bahl and P. Bhartia, *Microwave Solid State Circuit Design*, John Wiley & Sons (1988), pp. 271–276. A computer program using numerical optimization techniques may be used to determine a solution to the complex matrix equation. When a solution has been obtained, a filter based on it may be constructed using conventional techniques. The sizes and shapes of the cavities, the materials used to build the filter, and the physical characteristics of each coupling all affect the filter's frequency response.

A coupling coefficient describes a coupling's magnitude and phase characteristics, which are affected by many factors, such as a coupling's type, size, and shape. For the simultaneous couplings of the first filter embodiment described above in connection with FIG. 5, the phase characteristic is simply either "positive," i.e. in-phase with the main couplings, or "negative," i.e. out-of-phase with the main couplings, depending on the factors mentioned above. This positive or negative phase characteristic determines on which side of the passband a particular finite-frequency insertion loss pole will be located. Assume the filter's main couplings are positive value quantities. If the phase characteristic for both simultaneous couplings is negative, then the two finite-frequency insertion loss poles will lie on the right side of the passband, producing an asymmetric frequency response, with the right side skirt much sharper than the left side skirt. If both simultaneous couplings have a positive phase characteristic, the two poles will lie on the left side of the passband, also producing an asymmetric response. If one simultaneous coupling has a positive phase characteristic and one has a negative phase characteristic, one finite-frequency insertion loss pole will lie on each side of the passband, producing a symmetric frequency response. Each of these possible responses will be quasi-elliptic on the side of the passband in which the poles lie.

Figure 11:
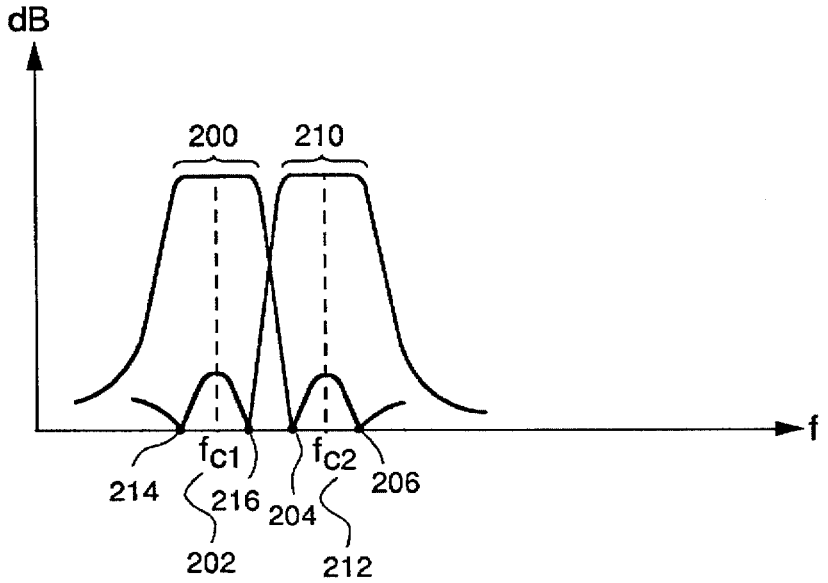
FIG. 11 is a plot of a frequency response produced by a diplexer using two bandpass filters as shown in FIG. 5
Figure 12:
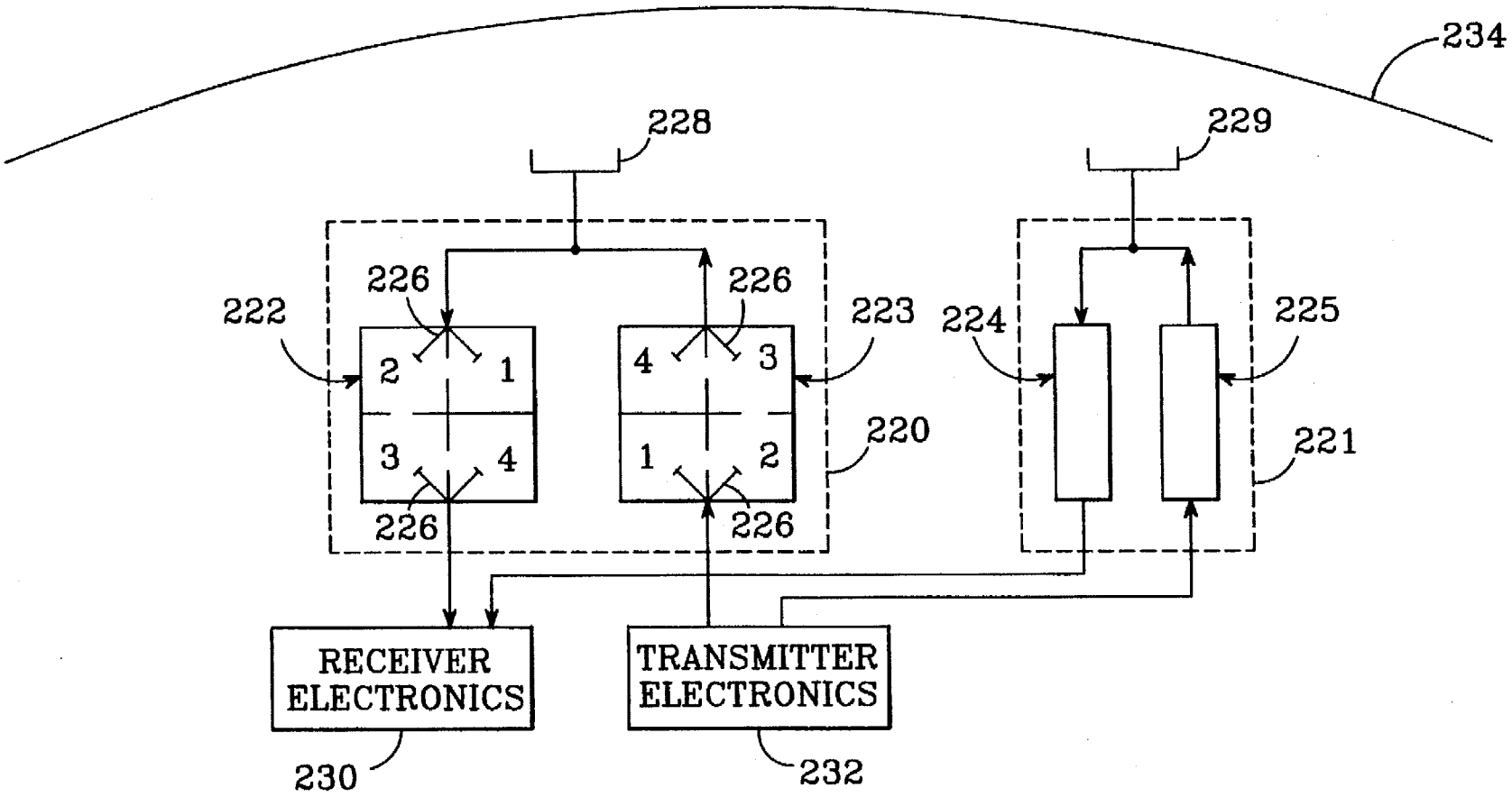
FIG. 12 is a block diagram of a satellite communications system which includes a simplified schematic of diplexers comprised of two bandpass filters per the present invention.

A diplexer is constructed using two bandpass filters, in which one filter has a response as shown in FIG. 8 and the second filter has a response as shown in FIG. 9. FIG. 11 shows this combination of frequency responses for a properly designed diplexer. The receive filter is designed to provide a passband 200 around carrier frequency $f_{c1}$ (202) and has two insertion loss poles 204, 206 located to the right side of its passband 200 to provide the necessary sharpness and asymmetry. The transmit filter provides a passband 210 around carrier frequency $f_{c2}$ (212), which is typically as close to $f_{c1}$ as the filters permit, and locates its poles 214, 216 to the left side of the passband. In, for example, a satellite communications system as shown in FIG. 12, these responses may be provided by a diplexer 220 and 221 constructed from two four-cavity filters 222, 223 and 224, 225 respectively, each having two simultaneous couplings 226 as discussed above. The diplexer offers excellent isolation between transmitted and received signals, as is needed for a diplexer 220, 221 connected to the same antenna element 228, 229, respectively, for both transmission and reception, and low distortion and attenuation in the passband regions. Use of a diplexer 220, 221 with these characteristics enables the communications payloads 230, 232 aboard an orbiting satellite to use only a single aperture antenna 234, a significant cost advantage, while satisfying both receive and transmit functions.

While particular embodiments of the invention have been shown and described, numerous variations and alternate embodiments will occur to those skilled in the art. Accordingly, it is intended that the invention be limited only in terms of the appended claims.

We claim:

1. A bandpass filter, comprising:

a plurality of resonant cavities, an input coupling, an output coupling and at least one main coupling, said cavities coupled together such that an input signal enters a first cavity through said input coupling, propagates through said first cavity and into a second cavity through one of said main couplings, continues to propagate sequentially through intervening cavities, a next-to-last cavity and a last cavity via said main couplings before exiting from said last cavity through said output coupling as an output signal, said first, second, intervening, next-to-last and last cavities between said input and output couplings forming a first signal path, said coupled resonant cavities forming a bandpass filter, and at least one additional coupling that either connects said input signal to a respective at least one cavity in said first signal path other than said first cavity such that said input signal is simultaneously coupled to said first and each of said respective at least one other cavity, or connects said output signal to a respective at least one cavity in said first signal path other than said last cavity such that said output signal is simultaneously coupled to said last and each of said respective at least one other cavity, each of said at least one additional coupling producing a respective finite-frequency insertion loss pole in the bandpass filter's frequency response.

2. The bandpass filter of claim 1, wherein said frequency response includes a passband portion, said at least one additional couplings configured to produce said respective finite-frequency insertion loss poles such that an unequal number of said loss poles lie on the left and right side of said passband portion creating an asymmetric bandpass filter with a quasi-elliptic frequency response.

3. The bandpass filter of claim 1, wherein said frequency response includes a passband portion, said at least one additional couplings configured to produce said respective finite-frequency insertion loss poles such that an equal number of said loss poles lie on the left and right side of said passband portion creating a symmetric bandpass filter with a quasi-elliptic frequency response.

4. The bandpass filter of claim 1, wherein each of said main couplings comprise respective apertures and wherein said input and output couplings and said at least one additional couplings each comprise respective metallic probes, each of said at least one additional couplings being internal to their respective cavities.

5. The bandpass filter of claim 1, wherein said filter operates in the microwave portion of the frequency spectrum.

6. A resonant cavity bandpass filter, comprising:

first, second, third and fourth resonant cavities, an input coupling, an output coupling and three main couplings, said cavities coupled together such that an input signal enters said first cavity through said input coupling, propagates through said first, second, third and fourth cavities sequentially via said main couplings, and exits from said fourth cavity through said output coupling as an output signal, said cavities forming a bandpass filter having a frequency response which includes a passband portion and a skirt portion on either side of said passband portion, a first additional coupling which connects said input signal to said second cavity so that said input signal is coupled to both first and second cavities creating a first simultaneous coupling, and a second additional coupling which connects said output signal to said third cavity so that said output signal is coupled to both third and fourth cavities creating a second simultaneous coupling, whereby said each of said additional couplings produces one finite-frequency insertion loss pole, each of said finite-frequency insertion loss poles sharpening the skirt portion of said frequency response on the side of the passband on which said pole lies.

7. The bandpass filter of claim 6, wherein said first and second additional couplings produce respective finite-frequency insertion loss poles that are both on the same side of said passband, said poles producing an asymmetric quasi-elliptic frequency response.

8. The bandpass filter of claim 6, wherein one of said first and second additional couplings produces a finite-frequency insertion loss pole on the left side of said passband and the other of said first and second additional couplings produces a finite-frequency insertion loss pole that is on the right side of said passband, said poles producing a symmetric quasi-elliptic frequency response.

9. The bandpass filter of claim 6, wherein said cavities are arranged in a folded-ladder structure with said third and fourth cavities adjacent to said second and first cavities, respectively.

10. The bandpass filter of claim 6, wherein said first simultaneous coupling includes one metallic probe protruding into said first cavity and another metallic probe protruding into said second cavity, and said second simultaneous coupling includes one metallic probe protruding into said third cavity and another metallic probe protruding into said fourth cavity.

11. The bandpass filter of claim 6, wherein said main couplings comprise apertures.

12. The bandpass filter of claim 6, wherein said filter operates in the microwave portion of the frequency spectrum.

13. A diplexer, comprising:

an antenna feed element, a first bandpass filter connected at one end to said antenna feed element for filtering received signals, and a second bandpass filter connected at one end to said antenna feed element for filtering signals to be transmitted, each of said filters comprising an input and an output and a plurality of resonant cavities which form a signal path between said input and output and having at least one simultaneous coupling made to a cavity in said signal path, each of said at least one simultaneous couplings creating respective finite-frequency insertion loss poles, said poles giving each filter an asymmetric, quasi-elliptic frequency response.

14. The diplexer of claim 13, wherein each of said filters provides a unique passband, whereby the asymmetric quasi-elliptic frequency response provided by said at least one simultaneous coupling allows the passbands to be closer together than without the use of simultaneous couplings, providing the diplexer with improved receive/transmit isolation.

15. A satellite communications system, comprising:

a satellite positioned in orbit around the earth, an antenna aboard said satellite for transmitting signals to the earth and receiving signals from the earth, a plurality of antenna feed elements, each of said elements feeding signals to said antenna and receiving signals from said antenna, and a plurality of diplexers connected to respective antenna feed elements, said diplexers each comprising a receive filter and a transmit filter connected at one end to said antenna feed element, each of said filters comprising an input and an output and a plurality of resonant cavities which form a signal path between said input and output and having at least one simultaneous coupling made to a cavity in said signal path, each of said at least one simultaneous couplings providing an asymmetric quasi-elliptic frequency response which provides its respective diplexer with improved receive/transmit isolation and enabling the use of said antenna to provide both transmit and receive functions aboard said satellite.

16. A resonant cavity bandpass filter, comprising:

first, second, third and fourth resonant cavities, an input coupling, an output coupling and three main couplings, said cavities coupled together such that an input signal enters said first cavity through said input coupling, propagates through said first, second, third and fourth cavities sequentially via said main couplings, and exits from said fourth cavity through said output coupling as an output signal, said cavities forming a bandpass filter having a frequency response which includes a passband portion and a skirt portion on either side of said passband portion, an additional coupling which connects said input signal to said second cavity so that said input signal is coupled to both first and second cavities creating a simultaneous coupling, whereby said additional coupling produces one finite-frequency insertion loss pole which sharpens the skirt portion of said frequency response on the side of the passband on which said pole lies.

17. A resonant cavity bandpass filter, comprising:

first, second, third and fourth resonant cavities, an input coupling, an output coupling and three main couplings, said cavities coupled together such that an input signal enters said first cavity through said input coupling, propagates through said first, second, third and fourth cavities sequentially via said main couplings, and exits from said fourth cavity through said output coupling as an output signal, said cavities forming a bandpass filter having a frequency response which includes a passband portion and a skirt portion on either side of said passband portion, an additional coupling which connects said output signal to said third cavity so that said output signal is coupled to both third and fourth cavities creating a simultaneous coupling, whereby said additional coupling produces one finite-frequency insertion loss pole which sharpens the skirt portion of said frequency response on the side of the passband on which said pole lies.

18. A method of producing finite-frequency insertion loss poles in a bandpass filter frequency response, comprising the steps of:

coupling an input signal into a first resonant cavity, propagating said signal sequentially through a series of resonant cavities, coupling said signal from a last resonant cavity to the outside of said series of cavities to extract an output signal, said series of cavities forming a bandpass filter, and additional coupling said input signal to one or more of said series of cavities other than said first resonant cavity, each of said additional couplings producing a finite-frequency insertion loss pole in said bandpass filter's frequency response.

19. The method of claim 18, further comprising the step of additionally coupling said output signal to one or more of said series of cavities other than said last cavity, each of said additional couplings producing a finite-frequency insertion loss pole in said bandpass filter's frequency response.

20. A method of producing finite-frequency insertion loss poles in a bandpass filter frequency response, comprising the steps of:

coupling an input signal into a first resonant cavity, propagating said signal sequentially through a series of resonant cavities that form a bandpass filter, extracting an output signal from a last cavity of said resonant cavities, and additionally coupling said output signal to one or more of said series of cavities other than said last cavity to produce a finite-frequency insertion loss pole in said bandpass filter's frequency response.

* * * * *